US005544431A

United States Patent [19]

Dixon

[11] Patent Number: 5,544,431

[45] Date of Patent: Aug. 13, 1996

[54] SHOCK ABSORBING SHOE WITH ADJUSTABLE INSERT

[76] Inventor: Roy Dixon, 1101 Grandview Cir., Royal Palm Beach, Fla. 33411

[21] Appl. No.: 491,097

[22] Filed: Jun. 16, 1995

[51] Int. Cl.[6] ..... A43B 21/30; A43B 13/28

[52] U.S. Cl. ..... 36/38.0; 36/27.0; 36/35 R; 36/37; 36/28.0

[58] Field of Search ..... 36/27, 38, 35 R, 36/37, 25 R, 34 R, 92, 28, 105, 115

[56] References Cited

U.S. PATENT DOCUMENTS

| | | | |
|---|---|---|---|
| 384,634 | 6/1888 | Martin | 36/38 |
| 1,094,211 | 4/1914 | Jenoi et al. | 36/38 |
| 4,845,863 | 7/1989 | Yung-Mao | 36/28 |
| 4,894,934 | 1/1990 | Illustrato . | |
| 5,138,776 | 8/1992 | Levin . | |
| 5,212,878 | 1/1992 | Burke et al. . | |
| 5,224,278 | 7/1993 | Jeon . | |

FOREIGN PATENT DOCUMENTS

| | | | |
|---|---|---|---|
| 618719 | 9/1934 | Germany | 36/38 |

*Primary Examiner*—Paul T. Sewell
*Assistant Examiner*—Marie Denise Patterson
*Attorney, Agent, or Firm*—McHale & Slavin, P.A.

[57] ABSTRACT

The instant invention is an improved sport shoe having a spring biased heel with operator insertable foam inserts for varying the biasing ability of the heel. The foam inserts are colored allowing instant determination of the type of activity the shoe is suitable for. The inserts allowing the wearer of the shoe to customize the shoe for a particular activity. High deceit foam inserts provide support for basketball or the like jumping sports. Medium deceit foam inserts provide support for aerobic or the like activities. Low deceit foam inserts provide support for low impact activities such as jogging and no foam inserts provide unlimited spring range suitable for cushioned walking.

8 Claims, 1 Drawing Sheet

SHOCK ABSORBING SHOE WITH ADJUSTABLE INSERT

FIELD OF THE INVENTION

The instant invention relates to footwear and more particularly to improved footwear in the way of sport shoes having cushioning springs placed within the heel of the shoe with wearer adjustable inserts.

BACKGROUND OF THE INVENTION

Numerous patents exists in the field of footwear. A primary purpose of footwear, namely shoes, is to protect the foot from injury. The sole of the shoe protects the foot and further operates to provide traction and cushioning. The cushioning may be as simple as a rubber slab or as elaborate as an air cushion.

Prior art shoes that incorporate a spring base were mainly novelty products providing an unpredictable platform that reacts to the various forces provided in direct relation to the tension of the spring. Springs incorporated into the heel of a shoe enhance cushioning but typically remain novelty products if the springs are not controllable. Various mechanics have been attempted to increase the cushioning effect of the heel.

U.S. Pat. No. 5,282,325 discloses a sports shoe having a spring disposed in the sole of a shoe. The spring operates to bias the foot in a raised position wherein the spring provides cushioning of the shoe against shocks from the ground. The spring utilizes a torsion spring placed along a longitudinal axis disposed horizontal to the ground using a spring constant to resist flexing of the spring. Further, the torsion spring placed along a horizontal plane inhibits complete compression of the spring as the coils cannot be collapsed.

U.S. Pat. No. 5,224,278 discloses another shoe having a spring base enhanced by an air bag positioned along the midsole for biasing the heel against shock.

U.S. Pat. No. 5,212,878 discloses a shoe having a biasing means placed in the sole. In this disclosure springs placed into the shoe allow the user to select the characteristics of the sole cushioning.

U.S. Pat. No. 5,138,776 discloses a shoe having a highly elastic heel for use in reducing the shock during running and jogging. The elastic heel operates as a cantilevered spring with no means for adjustment.

The problem remains in that it is not possible for the manufacturer of a shoe to envision the physical aspects of the purchaser of the product nor their use of the product. For instance, an average adult male having a 10-D shoe size can range from a short heavy-set person who may only walk for exercise to a tall athletic person who jumps rope for exercise. The point being the use of the shoe cannot be predicted as each person may not even know what they will use the shoes for. A consumer may use a shoe for various activities none of which would be appropriate for a particular shock absorbing spring shoe.

Most spring shoes are designed to accommodate average endeavors. For instance, an athletic person who purchases a spring based shoe may on one day choose to play basketball, another day play racquetball, another day he may simply walk a long distance. Each of these activities require various types of support for optimum comfort. The problem with a spring based shoe which may be appropriate for walking may be dangerous for basketball where quick stops are necessary. Thus, an individual may need to purchase numerous pairs of shoes to accommodate a range of activities.

In spite of the prior art, a clear need remains for better solutions to the problems addressed by the prior art, namely, the ability to relieve shock loads encountered by wearers of the footwear yet provide optimum comfort for a specific activity. There remains a need for consumer adjustable shock absorbing shoes.

SUMMARY OF THE INVENTION

The instant invention is an improved sport shoe having a plurality of springs placed within the heel of the shoe further allowing for the insertion of foam rubber inserts. The inserts can be exchanged by the wearer to accommodate a particular activity.

For instance, the wearer of the instant invention may choose not to use an insert when the footwear is used for walking purposes. In such an application, the amount of spring travel is uninhibited allowing for a most comfortable piece of footwear that allows the footwear to absorb nearly all the shocks encountered while walking. The use of a shoe having unbridled springs in a more active situation may be novel but is not acceptable for extremely active sports such as basketball.

In more active situations, a foam insert can be placed between the springs which operates to lessen the effectiveness of the spring yet maintains an uplift provided by a spring loaded shoe. In other activities such as jogging, an insert of medium density is positionable between the springs which allows a range of motions of the springs yet inhibits over-extension. Preferably each insert is color-coded so as to allow for quick determination of the density and thus expected results of the insert when properly placed between the spring.

The opening side wall of the shoe heel includes a clear plastic viewing port for aesthetic purposes as well as allowing the individual to determine which insert is in place.

Thus, a prime objective of the subject invention is to provide footwear which relieves shock loads experienced by the wearer yet provides the ability for the wearer to adjust the amount of support provided by the shoe.

Another objective of the instant invention is to set forth an improved shoe having a plurality of springs placed within the heel receptive to various cushioning inserts so as to allow for user adjustability of the spring action provided by the heel placed springs.

Yet another objective of the instant invention is to provide colored inserts of various density allowing the user of the device to visually determine the level of spring action required to accommodate a particular activity.

Another objective of the instant invention is to provide clear side panels allowing for the determination of the type of insert in position as well as providing an aesthetically pleasing sporting footwear.

Yet still another objective of the instant invention is to place biasing foam cushions around each of the springs individually for customization of a particular shoe for a particular sporting activity.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention has been described in terms of a specific embodiment, it will be readily apparent to those skilled in this art that various modifications, rearrangements and substitutions can be made without departing from the spirit of the invention. The scope of the invention is defined by the claims appended hereto.

Figure 1:
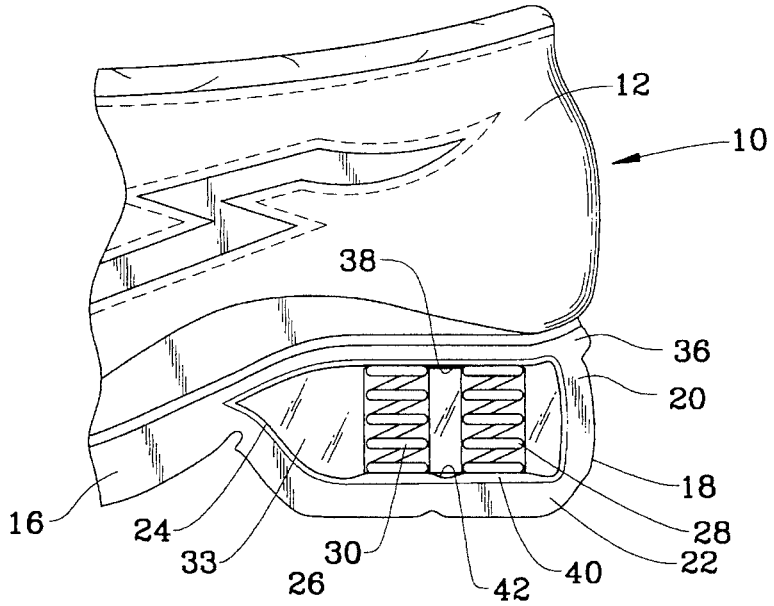
FIG. 1 is a plane side view of the invention incorporated into a sports shoe.

Now referring to FIG. 1, set forth is a sports shoe 10 incorporating the instant invention having a leather upper 12 forming a foot insertion hole 14 having a base provided by a 16 and heel 18. The heel 18 is further defined by a rear wall 20 downwardly dependent from the leather upper 12 and integrated into a ground planar platform 22 which is further integrated into the remainder of the sole 16 as illustrated by a curved upward front portion 24. It should be noted that the heel may be molded as part of the sole or formed independently and secured to the sole.

The inner portion of the heel 18 is hollow without sidewalls forming a horizontal aperture 26 which communicates one side surface of the heel to a second side surface. The aperture forms an upper surface 38 and a lower surface 42 wherein four springs are positioned.

Each spring, exemplified by spring 28, is formed from a stainless steel wire of approximately 5 millimeter diameter and approximately 40 millimeters in height. The springs are sufficiently rigid to prevent collapse of the heel under loading with memory resiliency biases against the ground causing a return spring force effectuate an uplifting effect in their walk. The spring action operates as shock absorption for the foot and provides an exhilarating walking step when the spring reacts to the compression.

The springs need not be as rigid as the prior art, so as to accept the total load weight of an individual in all situations, as the device can be adjusted for more strenuous activities. In particular, if an individual wearing the footwear is placed in a jumping position such as basketball, the springs would quickly collapse under a full load overextending the compression reaction area of the spring. Thus, the springs are not designed to accommodate all activities without use of inserts. In this manner, the invention includes the use of foam inserts of various densities so as to effectuate spring cushioning as well as fitting within the edges of the spring changing the resiliency aspect of each of the springs.

Spring 28 is exemplary of the remaining springs 30, 32 and 34. Spring 28 has an upper portion 36 which is securable against upper wall surface 38 and a lower portion 40 securable against lower surface 42. It is noted that the upper and lower portions of each said spring are tapered so as to smooth out the coil providing a flat surface for engagement of each wall surface. The planar platform 22 may include additional various traction surfaces and include a rubber cushion, so as to increase the cushioning effect, but is not deemed necessary for operation of the instant invention.

A clear plastic cover 33 is available for placement over the aperture 26 which allows viewing of the inner workings of the heel yet eliminates the possibility of placing fingers within the heel or having elements such as sand entering into the heel inhibiting operation of the springs. The clear plastic cover 33 further allows an individual to view what type of foam insert has been placed in the heel without the necessity of removing the insert for additional inspection. The plastic cover 33 may be attached by use of velcro along one side with the plastic having sufficient pliability so as to allow uninhibited movement of the heel during a particular activity.

Figure 2:
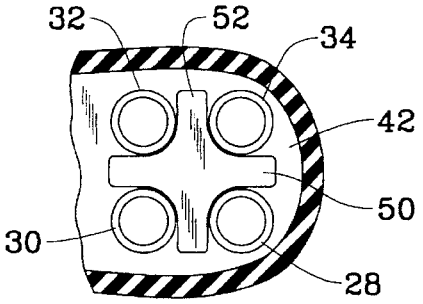
FIG. 2 is a cross-sectional top view of the heel portion of FIG. 1 including a foam insert.

Now referring to FIG. 2, a top view is shown illustrating springs 28, 30, 32, and 34 which are placed in an upright vertical position wherein placement of foam insert 50 is positioned between the springs. The insert is constructed from a foam material of a density determinable by the type of activity to be encountered. For example, an insert 50 constructed of a high density foam having minimal compression is suitable for placement in a heel portion wherein the individual would subject the footwear to excessive pounding such as that found in a sport of basketball. In this manner, a high density foam has minimal interference with the springs yet dampens their biasing ability by engaging a portion of the coil when each spring is compressed. The portion of the resiliency remains when the footwear comes down and engages the ground at an awkward position as the centrally disposed foam insert requires a flat placement of the heel to effectuate compression of the insert. Thus, an individual would not be able to put sufficient pressure on a corner of the heel without having a substantially flat contact with the ground which helps prevent injury to the individual. Should the individual attempt to place excessive pressure when not properly positioned is a leading cause of injury as the individual's foot may slide from beneath them. In this manner, spring resiliency forces the heel into a horizontal position where it is then permissible to place pressure onto the heel.

The insert 50 may also be made of various alternative densities such as a low density foam which makes the invention suitable for lower impact sports such as jogging. In lower impact sports it is desired that a certain amount of spring resiliency is maintained wherein the foam allows a larger range of spring motion yet inhibits excessive spring motion as the foam is actually squeezed between the coils of the spring during compression. A medium density foam is suitable for increased impact sports such as tennis, aerobics, and may further operate as an all around structural support for most activities.

The outer dimensions of the insert remain the same despite the density of the material making it useful to use various colors to determine what resiliency is placed within the heel. For instance, a red insert may designate high density for the most active sports. A blue insert may indicate periodic average activity sports, while a white insert may indicate light activity such as jogging. As previously mentioned, removal of the insert allows full range of motion for the springs and is suitable for extremely light activities where maximum cushioning is warranted such as walking.

The insert 50 is shown in a cross format with outwardly extending tabs 52 positionable between the springs allowing for insertion into a heel by simply placing a tip of a tab 52 into the center of the heel and pushing the opposing tabs into a center section between two springs thereby locking the insert in position. This allows the foam insert to remain stable without the necessity of adhesive and further allows removal of the insert upon demand. As the insert is constructed of foam, removal is simply performed by pulling on the wing 52 deforming opposite wings as pulled through the spring coil for release of the insert.

Figure 3:
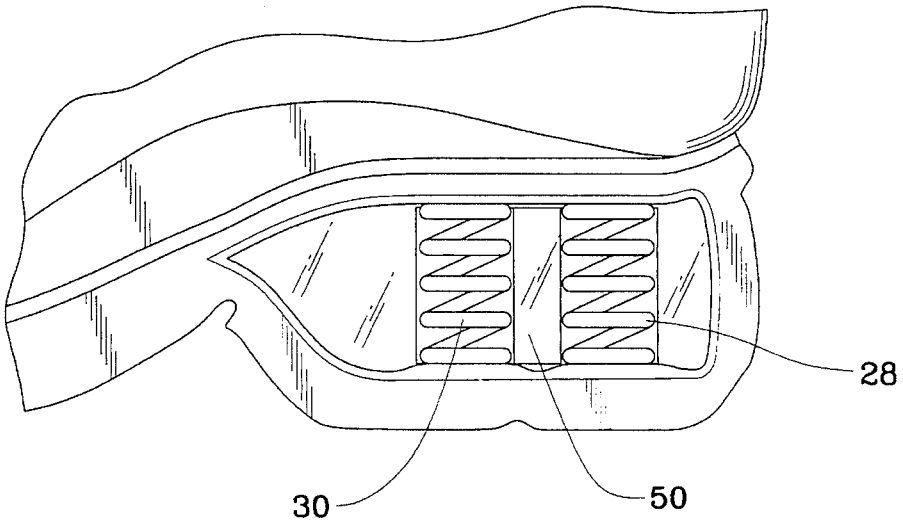
FIG. 3 is a cross-sectional top view of the heel with the springs compressed.

Referring to FIG. 3, the coils are shown in a fully compressed state wherein foam insert 50 is flattened causing insertion into individual coils that makeup the springs 28, 30, 32, and 34 inhibiting the springs from becoming completely compressed wherein the foam is trapped between each coil further operating as a sound inhibiting cushion. While the description sets forth the use of four springs as a preferred embodiment, it should be noted that various amounts of springs may be used such as three forming a triangular stance or even one wherein the form insert is shaped like a donut to encompass the spring.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

What is claimed is:

1. A sports shoe having an upper portion forming a covering for insertion of a foot and a lower portion secured to said upper portion forming a sole for support of the foot, the improvement comprising;

a spring biased heel section defined by a flexible rear wall having an upper edge secured to a bottom side surface of a sole support and a flexible front wall secured to said bottom side surface of said sole support, said sole support secured to said sole and said front wall spaced apart from said rear wall and adjoined thereto along a lower edge by a rigid support platform forming a chamber therebetween accessible by an aperture formed between said front and rear walls;

a plurality of coil springs having a known compression ratio in said chamber biasing said rigid support platform away from said sole; and a spring adjustment means removably insertable into said chamber for altering said compression ratio of said coil springs;

whereby said coil springs having a known compression ratio to provide a wearer of the shoe with a spring lift which reacts upon the application of weight to said springs wherein said spring adjustment means to control coil spring compression ratio allowing the wearer to personally adjust the coil spring compression ratio to accommodate the type of sporting event to be encountered.

2. The sports shoe according to claim 1 wherein said coiled springs are further defined as a plurality of vertically disposed coiled springs having an upper portion of each spring secured to said bottom surface of said sole support and a lower portion secured to said rigid support platform.

3. The sports shoe according to claim 2 wherein said spring means has at least two coiled springs having a vertical uncompressed height of about 40 mm with a spacing between each coil of about 5 mm.

4. The sports shoe according to claim 1 wherein said aperture opening is sized to allow for ease of insertion and removal of said spring adjustment means, wherein the operation of said coil springs and spring adjustment means is viewable through said aperture.

5. The sports shoe according to claim 1 wherein said spring adjustment means is insertable into said chamber for limiting said spring means.

6. The sports shoe according to claim 1 wherein said spring adjustment means is further defined as a foam insert having uniform density.

7. The sports shoe according to claim 6 wherein said foam insert is color-coded according to the density of said foam insert.

8. The sports shoe according to claim 1 including a clear plastic cover securable to each said side wall of said heel.

* * * * *